US005755883A

United States Patent [19]

Kinose et al.

[11] Patent Number: 5,755,883

[45] Date of Patent: May 26, 1998

[54] ROLL COATING DEVICE FOR FORMING A THIN FILM OF UNIFORM THICKNESS

[75] Inventors: Kazuo Kinose; Kazuto Ozaki, both of Shiga-ken; Tetsuo Azuma; Hideo Okada, both of Kyoto-fu, all of Japan

[73] Assignee: Dainippon Screen Mfg. Co., Ltd., Kyoto, Japan

[21] Appl. No.: 621,336

[22] Filed: Mar. 25, 1996

Related U.S. Application Data

[63] Continuation of Ser. No. 289,126, Aug. 11, 1994, abandoned, which is a continuation of Ser. No. 771,321, Oct. 2, 1991, abandoned.

[30] Foreign Application Priority Data

Oct. 5, 1990 [JP] Japan ..... 2-105385 U

[51] Int. Cl.[6] ..... B05C 1/02; B05C 1/08

[52] U.S. Cl. ..... 118/110; 118/120; 118/244; 118/258; 118/259; 118/261; 118/262; 118/248

[58] Field of Search ..... 118/203, 238, 118/251, 252, 259, 261, 262, 500, 110, 114, 115, 120, 244, 248, 253, 503, 258; 101/425, 350, 351, 363, 364, DIG. 34; 15/256.51, 256.52, 256.53

[56] References Cited

U.S. PATENT DOCUMENTS

| | | | |
|---|---|---|---|
| 1,324,474 | 12/1919 | Staude | 118/262 |
| 2,112,246 | 3/1938 | Maher | 118/262 |
| 2,659,340 | 11/1953 | Zinn | 118/212 |
| 3,605,687 | 9/1971 | Russell | 118/262 |
| 3,756,196 | 9/1973 | Furuuchi et al. | 118/238 |
| 3,916,824 | 11/1975 | Knodel et al. | 118/262 |
| 4,082,038 | 4/1978 | Ueno et al. | 101/425 |
| 4,246,301 | 1/1981 | Alheid et al. | 118/262 |
| 4,271,216 | 6/1981 | Shimizu | 118/224 |
| 4,485,132 | 11/1984 | Furuzono et al. | 118/262 |
| 4,589,337 | 5/1986 | Hardin | 101/363 |
| 4,642,839 | 2/1987 | Urban | 15/256.53 |
| 4,852,515 | 8/1989 | Terasaka et al. | 118/262 |
| 4,872,416 | 10/1989 | Daniel et al. | 118/203 |
| 4,928,623 | 5/1990 | Kojima | 118/262 |
| 4,949,667 | 8/1990 | Yoshida et al. | 118/262 |
| 5,523,122 | 6/1996 | Harada et al. | 118/253 |
| 5,631,048 | 5/1997 | Kinose et al. | 118/244 |

FOREIGN PATENT DOCUMENTS 51-122165 10/1976 Japan .

*Primary Examiner*—Steven P. Griffin

*Attorney, Agent, or Firm*—Ostrolenk, Faber, Gerb & Soffen, LLP

[57] ABSTRACT

A roll coater for forming a film of uniform thickness on a substrate W includes a bottom plate 6 for transporting the substrate W in a predetermined direction F, a coating rubber roll 4 for transferring a coating liquid Q adhering to the outer circumferential face onto the substrate W, and an ink supplying device for supplying ink to the outer circumferential face of the roll 4. The ink supplying device includes a roll 1 for transferring the coating liquid Q adhering to the outer circumferential face thereof to the outer circumferential surface of a roll 4, metal doctor 2 for supplying a coated film of a coating liquid Q of uniform thickness, and a coating liquid reservoir 3 for storing coating liquid Q. A scraper 7 for scraping the remaining coating liquid Q on the outer circumferential face of the metal roll 1 is provided downstream of the roll 4 and upstream of the coating liquid reservoir 3.

8 Claims, 8 Drawing Sheets

ROLL COATING DEVICE FOR FORMING A THIN FILM OF UNIFORM THICKNESS

This is a continuation of application Ser. No. 08/289,126, filed on Aug. 11, 1994, now abandeoned, which is a continuation of application Ser. No. 07/771,321, filed Oct. 2, 1991, now abandoned.

BACKGROUND OF THE INVENTION

1. Field of the Invention

The present invention relates to roll coating devices, and more particularly to a device for forming a film of uniform thickness by applying a coating liquid such as photoresist on the surface of a thin plate such as a glass substrate for a liquid crystal display device (referred to simply as "substrate" hereinafter).

2. Description of the Related Art

The need for technology suited for forming a film of uniform thickness, for example, of photoresist, on the surface of a substrate has been increasing commensurate with progress in semiconductor manufacturing technology using photolithography and the volume increase of manufactured high resolution liquid crystal displays. The demand for techniques for forming films of uniform thickness is great since film unevenness is responsible for unreliable devices and decreased manufacturing yields. One technique satisfying this need uses a roll coater.

A conventional roll coater is shown in FIG. 1. It includes a coating rubber roll 101 having a groove 101*a* formed at a minute pitch on the circumferential surface thereof for applying coating liquid Q to the surface of a substrate W; a doctor roll 102 rotatable about an axis and pressed against coating rubber roll 101 with adjustable pressure; a plurality of substrate transportation rollers 105 provided beneath coating rubber roll 101 for transporting substrate W along a horizontal transportation path; and a backup roll 106 provided opposite of coating rubber roll 101 with the transportation path of substrate W therebetween for backing up, i.e. supporting, substrate W which is being pressed by coating rubber roll 101 from the bottom thereof.

A coating liquid reservoir 103 holding coating liquid is defined above the "nip", i.e. point where coating rubber roll 101 and doctor roll 102 contact each other. A supplying tube 109 supplies coating liquid Q to coating liquid reservoir 103 from above coating liquid reservoir 103. Backup roll 106 contacts the coating rubber roll 101 with pressure which can be adjusted. Backup roll 106 is further constructed so that it can be lowered to allow substrate W to pass through the nip between coating rubber roll 101 and backup roll 106.

The conventional roll coater of FIG. 1 operates as follows. Supplying tube 109 provides coating liquid reservoir 103 with coating liquid Q. Coating liquid reservoir 103 stores a predetermined amount of coating liquid Q. Coating rubber roll 101 rotates in the direction shown by the arrow in FIG. 1. A portion of coating liquid Q stored in coating liquid reservoir 103 passes through the nip between roll 101 and roll 102 to adhere to the outer circumferential face of roll 101.

A substrate transportation roller 105 transports substrate W horizontally along a transportation path configured to insert substrate W in the nip between roll 101 and backup roll 106, which rolls rotate counterclockwise and clockwise, respectively. Substrate W passes the nip sandwiched between rolls 101 and 106 in the transportation direction. At this time, coating liquid Q adhering to the outer circumferential face of coating rubber roll 101 is transferred onto the upper surface of substrate W to form a film of coating liquid Q on substrate W.

This conventional roll coater is suitable for applying a coating of liquid of relatively high viscosity to the surface of substrate W. However, this roll coater is not suited for coating liquid of low viscosity. If a film is to be formed with a coating liquid of low viscosity, the minute grooves 110*a* on the outer circumferential face of roll 101 will cause unevenness in the film thickness of the coated film formed on the surface of substrate W.

A roll coater is disclosed in Japanese Patent Publication No. 58-1980 that can form a coated film of uniform thickness with a coating liquid having various values of viscosity. Referring to FIG. 2, this roll coater includes a coating liquid reservoir 111 for storing coating liquid Q; a pickup roll 112 having at least a portion of the outer circumferential face thereof dipped and rotated within the coating liquid stored in coating liquid reservoir 111 to have a portion of coating liquid Q stored in coating liquid reservoir 111 adhere to the surface thereof; a coating rubber roll 114 that is movable to be pressed against pickup roll 112 with adjustable pressure and to be withdrawn away from coating rubber roll 114; a rotatable backup roll 115 in contact with coating rubber roll 114; and a doctor roll 113 for contacting the pickup roll 112 with an adjustable pressure for removing excessive coating liquid Q adhering to the outer circumferential face of pickup roll 112.

Doctor roll 113, pickup roll 112, coating rubber roll 114, and backup roll 115 all rotate clockwise. Each of these rolls rotates so that the outer circumferential face thereof moves in a direction opposite to the movement of the outer circumferential face of another roll at the nip therebetween. A web-like sheet S to be coated passes the nip between coating rubber roll 114 and backup roll 115 according to and in the same direction of movement of the outer circumferential face of backup roll 115.

Doctor roll 113 contacts the pickup roll 112 upstream of the nip between the outer circumferential face of pickup roll 112 and coating rubber roll 114.

The roll coater of FIG. 2 operates as follows. Coating liquid reservoir 111 has a predetermined amount of coating liquid Q stored therein in advance. Pickup roll 112 rotates in the direction shown by the arrow, whereby coating liquid Q adheres to the outer circumferential face of pickup roll 112. Excessive coating liquid Q of the carried off liquid is removed by doctor roll 113. The remaining coating liquid Q is transferred to the outer circumferential face of coating rubber roll 114 from pickup roll 112 at the nip between coating rubber roll 114 and pickup roll 112. Similarly, coating liquid Q on the outer circumferential face of coating rubber roll 114 is transferred to the surface of the web-like sheet S at the nip between coating rubber roll 114 and backup roll 115.

The roll coater of FIG. 2 can form a film of relatively uniform film thickness by adjusting the contact pressure between the rolls and the rotation velocity of each roll according to the viscosity of the coating liquid Q being used. However, this roll coater has the following problems.

The axial length of coating rubber roll 114 is longer than the width of the web-like sheet S. The ends of coating rubber roll 114 are not in contact with the surface of sheet S. This means that coating liquid Q' remains on the surface of this portion of coating rubber roll 114, as shown by the chain line with two dots in FIG. 2. The remaining coating liquid Q' is transferred back to the surface of roll 112 at the nip between rolls 114 and 112. The remaining coating liquid Q' adhering to the surface of pickup roll 112 is then returned to coating liquid reservoir 111. Leftover coating liquid Q' added to the clean coating liquid Q in coating liquid reservoir 111 then degrades the quality of the clean coating liquid Q. It will become difficult to form a coated film of high quality if the quality of coating liquid is degraded. This problem is also present in the roll coater of FIG. 1.

A case is now considered in the device of FIG. 2 where a plurality of substrates, instead of sheet S, are sequentially fed between coating rubber roll 114 and backup roll 115. There is a space between each substrate passing through the nip of rolls 114 and 115. Formation of this space induces another problem contributing to coating liquid degradation. Coating liquid Q adhering to the outer circumferential face of coating rubber roll 114 will not be transferred to the surface of the substrate at the spaces. Coating liquid Q corresponding to the area of the spaces is transferred to pickup roll 112 as leftover coating liquid Q'. Thus, coating liquid Q within coating liquid reservoir 111 is decreased. This problem is also encountered in the roll coater of FIG. 1.

SUMMARY OF THE INVENTION

One object of the present invention is to enable forming a film of a coating liquid of various viscosities and of uniform thickness and to enable maintaining the quality of the coating liquid in satisfactory condition.

Another object of the present invention is to provide a roll coating device that can form a film of uniform thickness of a coating liquid of various viscosities and that can maintain the quality of the coating liquid.

A further object of the present invention is to enable forming a film of uniform thickness regardless of the viscosity of the coating liquid, and to prevent the introduction of substances inducing quality degradation of the coating liquid prepared for usage.

An additional object of the present invention is to allow the formation of a film of uniform thickness with a coating liquid of various viscosities, and to prevent substances inducing quality degradation from adhering to components that come into contact with the coating liquid prepared for usage.

A still further object of the present invention is to allow formation of a coated film of uniform film thickness regardless of the viscosity of a coating liquid, and to remove substances inducing quality degradation of a coating liquid adhering to components that come into contact with the coating liquid prepared for usage from the component thereof.

Yet another object of the present invention is to remove substances inducing quality degradation of a coating liquid adhering to components that come into contact with the coating liquid prepared for usage from all of the portions of the component that come into contact with the coating liquid.

A still further object of the present invention is to allow formation of a film of uniform thickness with a coating liquid of various viscosities, and to prevent the generation and introduction of excessive coating liquid into the coating liquid prepared for usage, by maintaining the amount of coating liquid used in forming a coating film at an adequate amount.

A roll coating device according to the present invention includes: a transporting device for transporting an object to be coated having a surface to be coated in a predetermined direction along a predetermined transportation path; a coating device provided at a side facing the surface to be coated along the transportation path, and having an outer circumferential face on which coating liquid is to be applied, for coating a coating liquid on the surface to be coated by the outer circumferential face coming into contact with the surface to be coated; a coating liquid transferring device having an outer circumferential face on which a coating liquid is to be applied for transferring the coating liquid to the outer circumferential face of the coating device by having the outer circumferential face thereof come into contact with the outer circumferential face of the coating device; a coating liquid supplying device for supplying a predetermined amount of coating liquid onto the outer circumferential face of the coating liquid transferring device; and a remaining coating liquid collecting device provided at a predetermined position of the outer circumferential face of the coating liquid transferring device for collecting coating liquid remaining on the outer circumferential face of the coating liquid transferring device, after the coating liquid is transferred from the coating liquid transferring device to the outer circumferential face of the coating device.

The coating liquid transferred from the coating liquid supplying device to the outer circumferential face of the coating device is transferred from the coating device to the surface to be coated. The coating liquid remaining on the outer circumferential face of the coating liquid supplying device is collected by the remaining coating liquid collecting device, and will not remain on the outer circumferential face of the coating liquid supplying device. The coating liquid supplied to the outer circumferential face of the coating liquid supplying device will not be contaminated by the remaining coating liquid. Also, a permanent layer of coating liquid remaining on the outer circumferential faces of the coating liquid supplying device and the coating device will not be formed. Thus, the quality of the coating liquid is maintained, and the thickness of the coated film formed on the surface to be coated is constant.

According to a preferred embodiment of the present invention, a coating liquid transferring device of a coating device includes a coating liquid transfer roll having a predetermined rotation axis for transferring a coating liquid onto the outer circumferential face of the coating device by rotating around its rotation axis and coming into contact with the outer circumferential face of the coating device, and a holding device for holding the coating liquid transferring roll rotatably around the rotation axis thereof, and to be pressed against the coating device with a predetermined pressure while being detachable therefrom.

With the above-described coating device, a coated film of a constant film thickness can be formed even while using coating liquid of various viscosities by adjusting adequately the contact pressure between the coating liquid transferring roll and the coating device.

According to another preferred embodiment of the present invention, the coating liquid supplying device of the coating device includes: a coating liquid passage regulating device having an outer circumferential face divided into a smooth portion and a notch portion to define a coating liquid reservoir region for storing coating liquid above a contact position with the coating liquid transferring roll for allowing only a predetermined amount of coating liquid from the coating liquid reservoir region to pass the contact portion with the coating liquid transferring roll by being in contact with the outer circumferential face of the coating liquid transferring roll; and a pressure holding device for adjusting the amount of coating liquid passing between the coating liquid transferring roll, and the contact location and adhering to the outer circumferential face of the coating liquid transferring roll, by holding the coating liquid passage regulating device to be in contact with the coating liquid transferring roll only at the smooth portion and by holding the coating liquid passage regulating device towards the coating liquid transferring roll with a predetermined pressure while being departable. The coating device further includes a stirring device for stirring the coating liquid within the coating liquid reservoir region. In such a coating device, a shearing force acts upon the passing coating liquid at the boundary between the smooth portion and the notch portion of the outer circumferential face of the coating liquid passage regulating device. Thus, the amount of coating liquid from the coating liquid reservoir region adhering to the outer circumferential face of the coating liquid transferring roll can be controlled easily to form a film coat of a desired and constant film thickness according to the viscosity of the coating liquid.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 3:
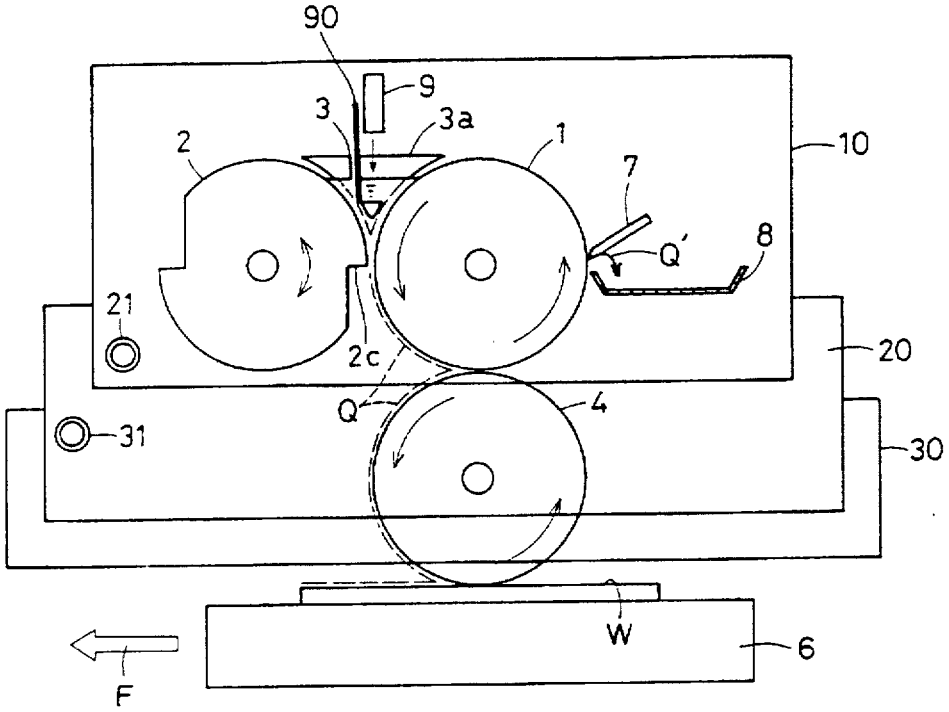
FIG. 3 is a schematic sectional view of a roll coater according to the present invention.

Referring to FIG. 3, a roll coater according to an embodiment of the present invention includes a fixed base 30, a lower support frame 20 rotatably attached to base 30 at a shaft 31 provided in the proximity of one edge portion of base 30, and an upper support frame 10 attached rotatably to lower support frame 20 at shaft 21 provided in the proximity of one edge of lower support frame 20. A substrate transportation fixing bed 6 is provided beneath base 30 to hold substrate W thereon and to transfer substrate W in a horizontal direction indicated by arrow F. A rotation shaft for coating rubber roll 4 is provided in lower support frame 20. Coating rubber roll 4 functions to apply the coating liquid Q adhering to the circumferential surface thereof to the surface of substrate W.

Upper support frame 10 includes a metal roll 1 of a smooth outer circumferential face, and a substantially circular metal doctor 2 with a notch 2*c* at the outer circumferential face rotatable around the rotation axis within a predetermined angle range. Metal roll 1 and metal doctor 2 are provided so that the gap between the outer circumferential faces is adjustable. In the proximity of both edges of roll 1 above the nip between metal roll 1 and metal doctor 2, a pair of retaining members 3*a* are provided, adjustable in position, in the axial direction of roll 1 to define the outer limits of coating liquid reservoir 3 for storing a coating liquid therein.

A supplying tube 9 for supplying coating liquid Q to coating liquid reservoir 3 is provided above coating liquid reservoir 3. A stirring rod 90 has at least one portion thereof dipped in the coating liquid stored in coating liquid reservoir 3 to maintain the coating liquid Q clean by stirring the coating liquid Q in coating liquid reservoir 3.

Since the support frame 10 and metal roll 1 are rotatable around shaft 21, the metal roll 1 serves to press on the coating rubber roll 4 with a pressure determined by the weight of upper support frame 10 and its attachments. Metal roll 1 is rotatable in the direction indicated by the arrow. A blade-like scraper 7 for scraping coating liquid Q' remaining on the outer circumferential face of metal roll 1, and a tray 8 for receiving coating liquid Q1 scraped off by scraper 7 are provided downstream of the nip relative to coating rubber roll 4 and upstream of coating liquid reservoir 3.

As described before, notch 2*c* is provided in metal doctor 2. Metal doctor 2 is located with respect to metal roll 1 to provide an adjustable gap therebetween. The angle of metal doctor 2 can be adjusted, as described before.

The load, i.e. weight, of upper support frame 10 and its attachments is applied to coating rubber roll 4 via metal roll 1. Coating rubber roll 4 is movable upwards and downwards with lower support frame 20, whereby the load of upper support frame 10 and its attachments and the load of lower support frame 20 and its attachments press substrate W onto fixing bed 6.

Scraper 7 is reciprocatable in the axial direction of metal roll 1, whereby leftover coating liquid Q' on the outer circumferential surface of metal roll 1 can be scraped off across the entire width of metal roll 1.

Figure 3A:
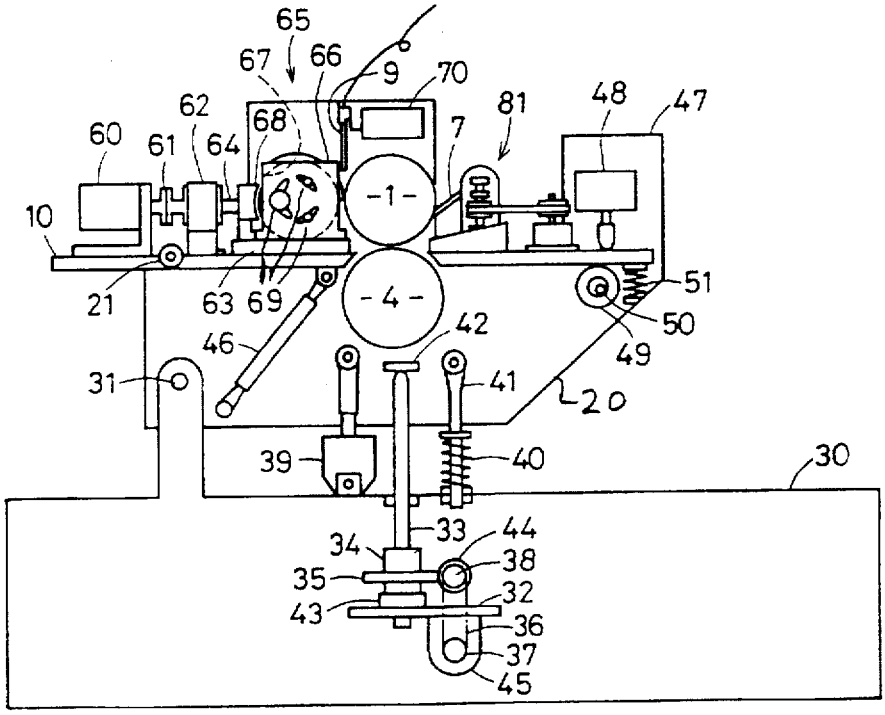
FIG. 3A schematically shows the mechanism for adjusting the contact pressure and the gap size between rolls 1 and 4, and between roll 1 and metal doctor 2 of a first embodiment of the present invention.

FIG. 3A schematically shows the mechanism of the contact pressure between the rolls of the roll coater of FIG. 3. Referring to FIG. 3A, the shaft 31 of lower support frame 20 is provided in base 30 of the roll coater. Lower support frame 20 comes into contact with base 30 under adjustable pressure by the following mechanism.

A table 32 is provided inside base 30. Table 32 has a linear pusher 33 attached thereto in a vertically slidable manner via a ball thread 34 and a bearing 43. A worm wheel 35 is provided around ball thread 34. A worm gear 38 that engages with worm wheel 35 is provided above table 32. A motor 45 is provided beneath table 32 to rotate worm gear 38. Worm gear 38 and motor 45 are coupled by a pulley 37, a pulley 44 and a timing belt 36. The upper end of linear pusher 33 abuts against a member 42 provided in lower support frame 20.

An air cylinder 39 is fixed on the upper portion of base 30. The end of the rod of air cylinder 39 is fixed to a point of lower support frame 20. Air cylinder 39 biases lower support frame 20 downwards. A shaft 41 that can slide upwards and downwards is provided at the upper portion of base 30. The end of shaft 41 is fixed to a point of lower support frame 20. A spring stopper is provided at the lower portion of shaft 41. A spring 40 is provided between this spring stopper and the surface of base 30. Spring 40 and shaft 41 bias lower support frame 20 upwards. Spring 40 and shaft 41 are provided to lift roll 4 upwards in order to prevent adverse effect on roll 4 caused by electric power failure wherein roll 4 continuously presses the surface of a substrate and the like.

Since air cylinder 39 biases lower support frame 20 downwards, roll 4 of lower support frame 20 moves towards base 30 to come into contact with substrate W of FIG. 3 at a predetermined pressure. The pressure between roll 4 and substrate W can be adjusted by adjusting the position of lower support frame 20 upwards or downwards with linear pusher 33.

Linear pusher 33 moves upwards and downwards by the following operation. The rotation of motor 45 causes worm gear 38 to rotate. In response to the rotation of worm gear 38, worm wheel 35 and, accordingly, ball thread 34 rotate. In response to the rotation of ball thread 34, linear pusher 33 moves upwards or downwards within ball thread 34 to raise lower support frame 20.

The mechanism for adjusting the pressure between metal roll 1 and roll 4 includes: a damper 46 with the ends rotatably fixed to the bottom surface of upper support frame 10 and to a point of lower support frame 20 for facilitating the upward movement of upper support frame 10 at the time of maintenance of upper support frame 10; an air cylinder 48 fixed to a side wall 47 of lower support frame 20 extending over the side of upper support frame 10; a bearing 49 abutting upwards right beneath the point where the end of the rod of air cylinder 48 abuts against the bottom face of upper support frame 10; an eccentric shaft 50 fitting into the shaft portion of bearing 49; and a spring 51 provided between the bottom of the leading edge of upper support frame 10 and a stopper fixed in lower frame 20 for biasing upwards the leading edge of upper support frame 10. A worm wheel (not shown) is provided at one end of bearing 49. This worm wheel can be rotated by a motor and a worm gear (not shown).

Air cylinder 48 biases upper support frame 10 downwards. The rotation of a motor (not shown) causes eccentric shaft 50 to rotate. In response to the rotation of eccentric shaft 50, bearing 50 slightly moves upwards or downwards. The upward or downward movement of bearing 50 causes upper support frame 10 to move slightly upwards and downwards to adjust the pressure between rolls 1 and 4.

The mechanism to adjust the gap amount between metal doctor 2 and metal roll 1 includes a servo motor 60 fixed on upper support frame 10, a ball thread 62 coupled to servo motor 60 via a coupler 61 for rotating in response to the rotation of the rotation axis of servo motor 60, and a shaft 64 fitting into ball thread 62. The end of shaft 64 is coupled to a metal doctor holding mechanism 65 which is slidable above upper support frame 10 via a linear guide 63.

The rotation of the rotation axis of servo motor 60 is transmitted to ball thread 62 via coupler 61. Ball thread 62 rotates, so that shaft 64 moves backwards and forwards. This causes mechanism 65 at the leading edge of shaft 64 to also move backwards and forwards to adjust the contact pressure and the gap amount between metal doctor 2 and metal roll 1.

The mechanism of adjusting the angle of the rotation position of metal doctor 2 includes a side plate 66 with three openings slidably fixed to linear guide 63, a worm wheel 67 provided at the side of metal doctor 2 to be concentric with metal doctor 2, a manually rotatable worm gear 68 fixed to side plate 66 and engaged with worm wheel 67, and three screws 69 engaging with threaded openings (not shown) formed on the side of metal doctor 2 through the three openings of side plate 66 for fixing metal doctor 2.

The adjustment of the angle of the rotation position of metal doctor 2 is carried out as follows. The rotation of worm gear 68 causes worm wheel 67 to rotate slightly. Because worm wheel 67 is fixed to metal doctor 2, metal doctor 2 also rotates. Metal doctor 2 is fixed by screws 69 at a desired position by this rotation. This allows the adjustment of an arbitrary angle for metal doctor 2 to implement optimum contact pressure and gap amount between metal doctor 2 and metal roll 2.

FIG. 3A shows a scraper 7, a mechanism 81 for reciprocating scraper 7, a nozzle 9, and a nozzle reciprocation mechanism 70 for stirring up coating liquid Q by reciprocating nozzle 9. These components will be described in detail hereinafter.

Figure 3B:
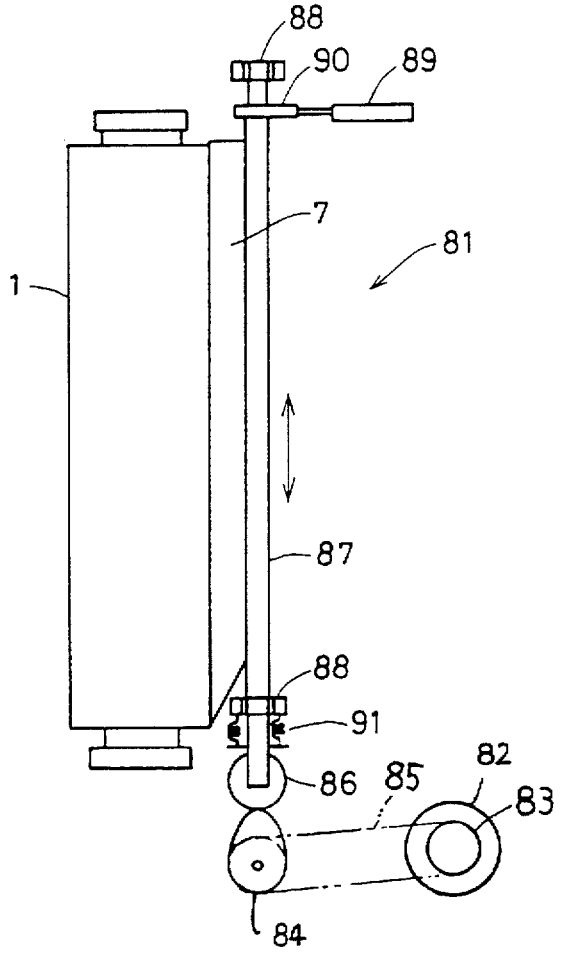
FIG. 3B is a schematic plan view of the mechanism for reciprocating a scraper.
Figure 3C:
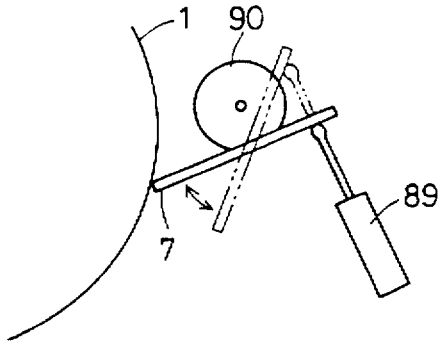
FIG. 3C is a schematic side view of the mechanism for pushing forward/withdrawing a scraper.

Referring to FIG. 3B, mechanism 81 for reciprocating scraper 7 includes: a shaft 87 with the ends held on the upper face of upper support frame 10 by slide bearings 88 for holding scraper 7; a circular cam 86 provided at one end of shaft 87; an eccentric cam 84 provided contact-rotatably with cam 86, above upper support frame 10; a motor 82 for rotating eccentric cam 84; a pulley 83 fixed to the rotation axis of motor 82; a timing belt 85 for coupling pulley 83 and the pulley of eccentric cam 84; and a spring 91 provided between circular cam 86 and slide bearing 88 of shaft 87 for biasing shaft 87 towards eccentric cam 84. A disk 90 fixed to shaft 87 is provided near an end portion of shaft 87 opposite to circular cam 86. To disk 90 is connected a cylinder 89 for urging scraper 7 to abut metal roll 1 or for separating scraper 7 from metal roll 1 by rotating disk 90 as shown in the figure. Cylinder 89 is fixed to the upper face of upper support frame 10.

Referring to FIG. 3B, the rotation of the rotation axis of motor 82 is transmitted to eccentric cam 84 via pulley 83 and timing belt 85. In accordance with the rotation of eccentric cam 84, circular cam 86 and shaft 87 reciprocate in the direction of the arrow following the rotation of eccentric cam 84. In response, scraper 7 reciprocates along the surface of metal roll 1.

Figure 3D:
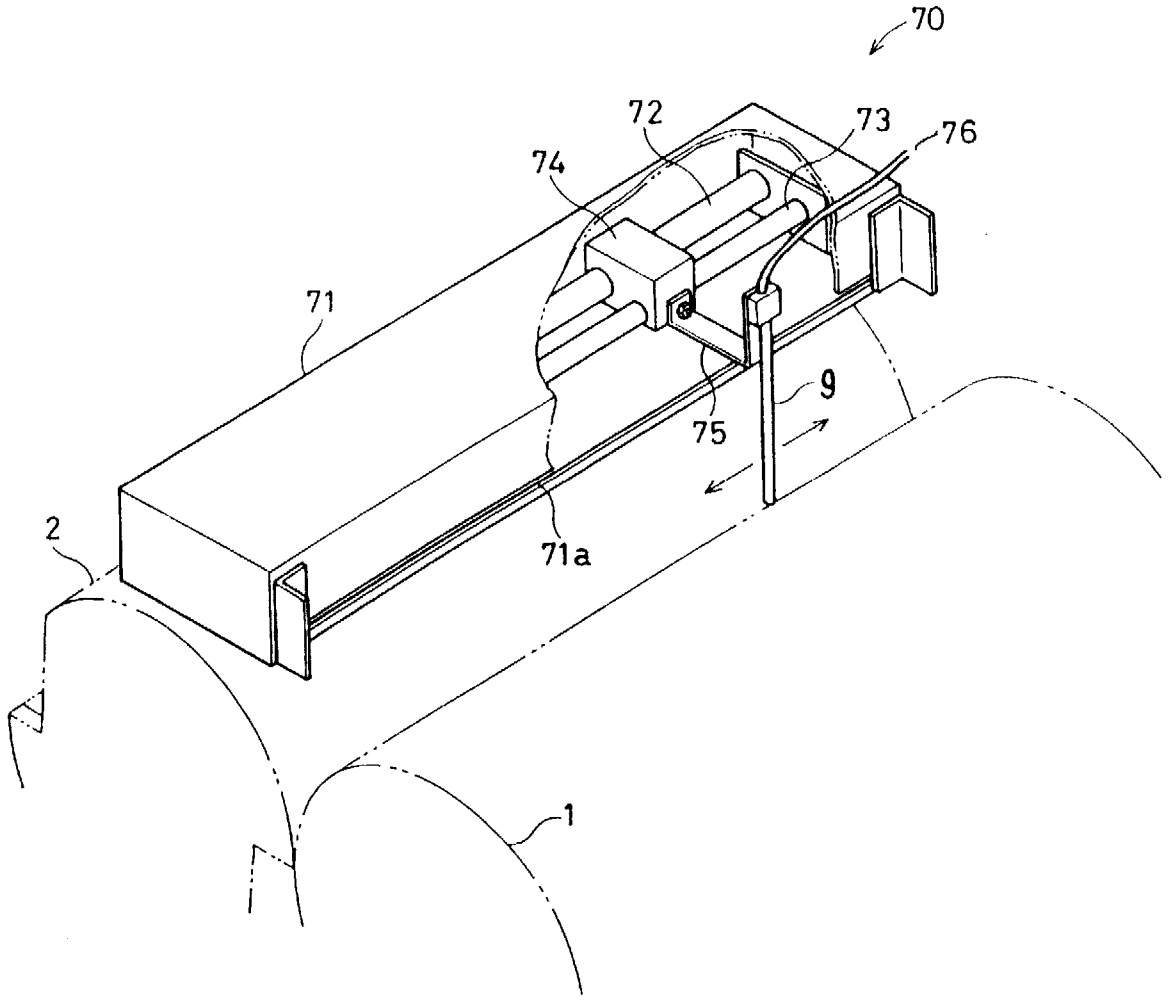
FIG. 3D is a perspective appearance of the mechanism for mixing a coating liquid reservoir with a portion broken out.

Referring to FIG. 3D, mechanism 70 for reciprocating nozzle 9 includes: a frame 71 provided above metal doctor 2, having an opening portion 71*a* in the side face near metal roll 1; a rodless cylinder 72 and a linear guide 73 provided in parallel to each other within frame 71; a head 74 traversing in parallel with the axis of metal doctor 2 by rodless cylinder 72 guided by linear guide 73; and a substantially L-shaped nozzle fixing member 75 provided in front of head 74, extending outwards from opening portion 71*a*. Nozzle 9 fixed at the upper end of nozzle fixing member 75 supplies processing liquid from a coating liquid supplying mechanism (not shown) via a flexible hose 76. The tip of nozzle 9 is dipped within the coating liquid in the coating liquid reservoir.

Head 74 reciprocates in parallel with the axis of metal doctor 2 by rodless cylinder 72. Nozzle 9 also reciprocates in parallel with the axis of metal roll 1 and metal doctor 2 within the coating liquid while supplying coating liquid to the coating liquid reservoir. The coating liquid is stirred up by nozzle 9.

Figure 3E:
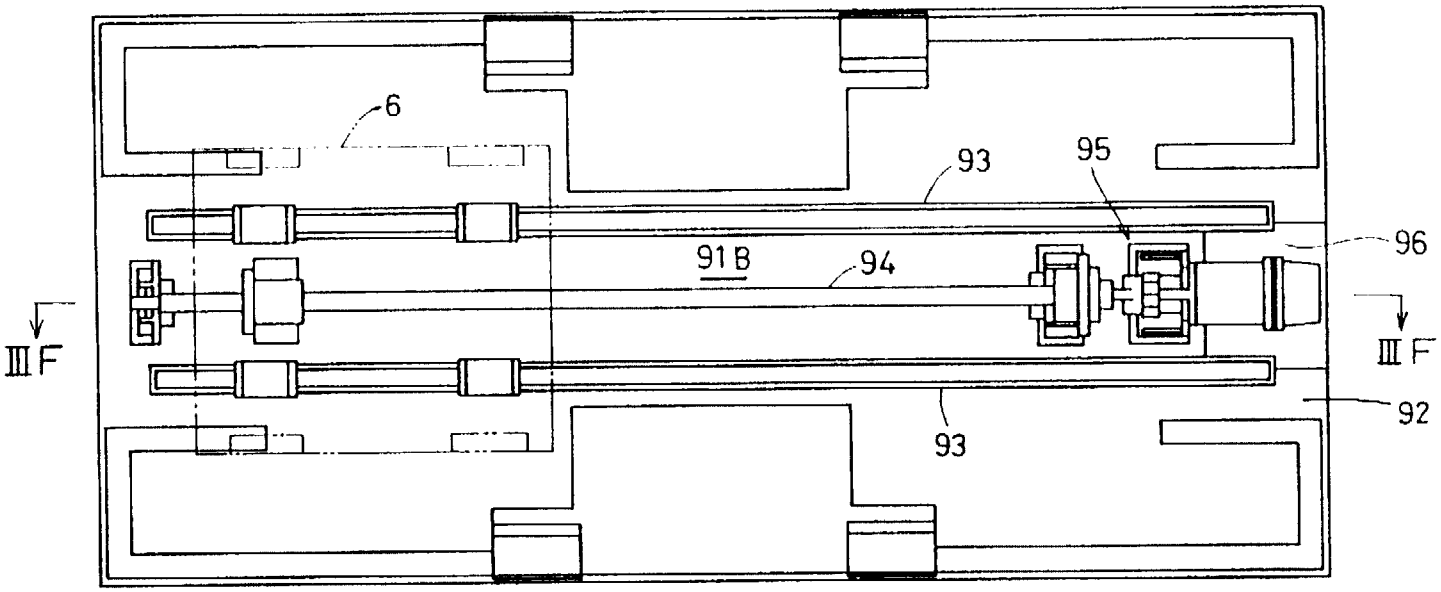
FIG. 3E is a plan view of the mechanism for traversing a fixing bed.
Figure 3F:
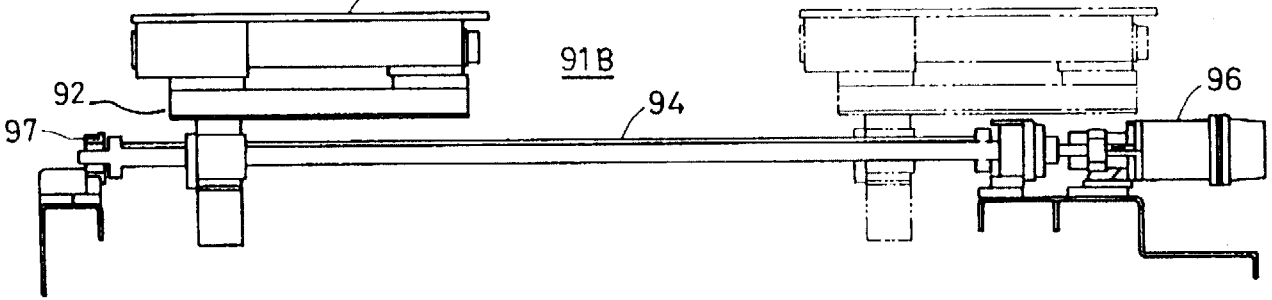
FIG. 3F is a side sectional view of the mechanism for traversing a fixing bed.

FIGS. 3E and 3F are, respectively, a plan view and a partial sectional view of mechanism 91B, for traversing fixing bed 6 horizontally and at a constant speed. Referring to both figures, mechanism 91B includes a base frame 92, a pair of linear guides 93 provided in parallel within base frame 92 for guiding fixing bed 6, a ball thread 94 provided in parallel to linear guides 93 between the pair of linear guides 93, and a servo motor 96 connected to ball thread 94 via a coupler 95. An engaging portion 97 engaging with ball thread 94 is provided beneath fixing bed 6.

Mechanism 91B operates as follows. Fixing bed 6 is placed first at the starting point of the substrate transportation path. The starting point is at a location most nearest to servo motor 96 in FIGS. 3E and 3F. When a substrate is mounted on fixing bed 6 at this position, the rotation axis of servo motor 96 starts to rotate in a predetermined direction. The rotation of motor 96 is transmitted to ball thread 94 via coupler 95. Following the rotation of ball thread 94, fixing bed 6 moves in a direction away from motor 96. When fixing bed 6 reaches the termination point of the transportation where the substrate is removed from fixing bed 6, the motor 96 starts to rotate in the opposite direction. This rotation causes fixing bed 6 to return to the starting point.

The traverse speed of fixing bed 6 is stable since it is driven by a servo motor. The support by the pair of linear guides 93 and ball thread 94 enables stable transportation of the substrate without the displacement of fixing bed 6 due to pressure from above.

Figure 3G:
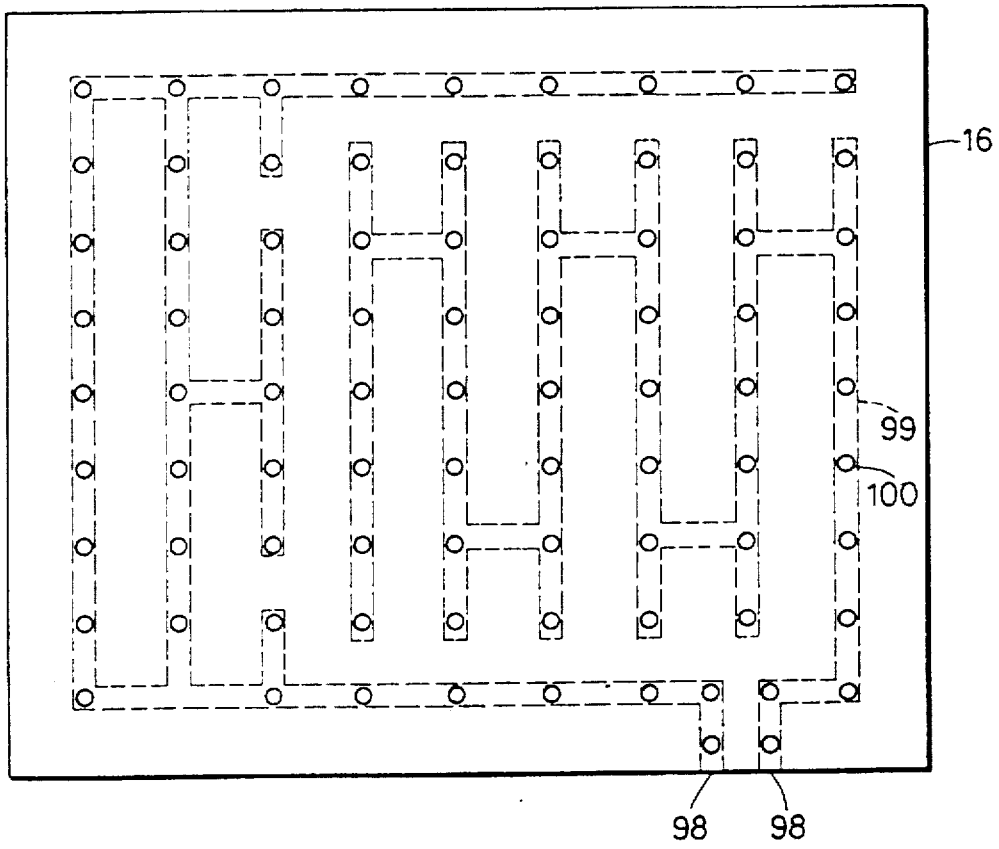
FIG. 3G schematically shows the mechanism for holding a substrate by suction.

FIG. 3G is a top plan view of fixing bed 6. It can be seen from FIG. 3G that a groove 99 for vacuum exhaust is provided at the back of the surface of fixing bed 6. Groove 99 is covered with a top plate. A plurality of holes 100 for suction are provided corresponding to the path of groove 99 in the top plate. The bottom face of the mounted substrate is drawn towards the top plate by discharging the air in groove 99 through exhaust ports 98 of FIG. 3G by a vacuum pump (not shown).

The roll coater of FIG. 3 operates as follows. Supplying tube 9 supplies coating liquid Q to coating liquid reservoir 3. Coating liquid reservoir 3 stores a predetermined amount of coating liquid. The rotation of metal roll 1 in the direction of the arrow in FIG. 3 causes a portion of coating liquid Q in coating liquid reservoir 3 to pass through the gap between metal roll 1 and metal doctor 2 to adhere to the outer circumferential face of metal roll 1. The amount of coating liquid Q passing through this gap can be established to a desired value by adjusting the gap between metal doctor 2 and metal roll 1. By fine-adjusting the rotation angle of metal doctor 2, a shearing force is applied to coating liquid 9 passing the gap between metal roll 1 and metal doctor 2 to form a layer of coating liquid Q of uniform thickness on the surface of metal roll 1. As mentioned before, the film thickness of the layer formed on the outer circumferential face of metal roll 1 can be made constant regardless of the viscosity of coating liquid Q, by adjusting the gap between metal roll 1 and metal doctor 2, as described before.

Since metal roll 1 and coating rubber roll 4 rotate in the same direction, the two rolls 1 and 4 rub against each other at the nip thereof so that coating liquid Q on metal roll 1 is completely transferred to the outer circumferential face of coating rubber roll 4.

Substrate transportation fixing bed 6 receives substrate W at a starting location from a substrate supplying device (not shown) to mount and hold substrate W thereon. Fixing bed 6 moves in the direction indicated by arrow F while holding substrate W thereon. Coating rubber roll 4 rotates in the direction indicated by the arrow at this time. Coating liquid Q adhering to the outer circumferential face of roll 4 is transferred to the surface of substrate W to form a coated film on the surface of substrate W. The travel of fixing bed 6 stops at the terminating position where substrate W is taken away by a substrate discharging means (not shown). Fixing bed 6 then returns to the starting location.

The above-described substrate transportation fixing bed 6 can transport substrate W in a horizontal direction at a stable speed. With transportation roller 105 and backup roll 106 of the conventional devices of FIGS. 1 and 2, the uniformity of the film thickness of the substrate is affected depending on how critically the rollers are parallel with each other, how round the cross-sectional shape of each roll is, and how long the rollers rotate without slipping relative to each other. The usage of fixing bed 6 shown in FIG. 3 can eliminate unevenness in the film thickness of the coated film which occurs due to the above-described reasons.

The transportation speed of substrate transportation fixing bed 6 can be adjusted. By changing the transportation speed of fixing bed 6 according to conditions such as the viscosity of coating liquid Q at the time of coated film formation, the film thickness of the coated film formed on substrate W can be readily adjusted to a predetermined value. The temperature of substrate W can be maintained at a predetermined value by providing a temperature adjusting mechanism (not shown) in fixing bed 6. This provides an adequate value for the viscosity of the coating liquid to be applied to substrate W to further reduce unevenness of the film thickness.

Thus, a major portion of coating liquid Q adhering to metal roll 1 is transferred to coating rubber roll 4, as described before. However, in some cases, a part of coating liquid Q on roll 4 is not transferred to the substrate and is again transferred from roll 4 to metal roll 1. This remaining coating liquid Q' must be reduced to a minimum. Otherwise, remaining coating liquid Q' is re-introduced into coating liquid reservoir 3 according to the rotation of metal roll 1 to degrade the quality of coating liquid Q not yet used. Scraper 7 is provided for this purpose. Scraper 7 is pressed against the outer circumferential face of metal roll 1 at a predetermined pressure to scrape off remaining coating liquid Q'. Coating liquid Q' scraped off is collected in tray 8.

If the length of scraper 7 is shorter than the width of the axial direction of metal roll 1, a fixed scraper 7 will only allow contacting of only a portion of the outer circumferential surface of metal roll 1. Remaining coating liquid Q' will not be removed from the other portions of the outer circumferential surface of metal roll 1 and will be introduced into coating liquid reservoir 3. If coating liquid Q' consistently remains on a particular region, there is a possibility of generating an uneven film thickness in that portion.

Scraper 7 is reciprocatable in the axial direction of metal roll 1 to solve this problem. The reciprocation of scraper 7 allows the removal of remaining coating liquid Q' from the entire width of the outer circumferential face of metal roll 1 to prevent contamination of coating liquid reservoir 3 and the formation of a permanent layer on metal roll 1 formed of coating liquid Q'.

As described before, coating rubber roll 4 can swing along with lower support frame 20 around shaft 31. Even if the plate thickness of substrate W changes, coating rubber roll 4 can move upwards or downwards according to the change in plate thickness to press the face of substrate W at a constant pressure. It is therefore possible to form a coated film of constant thickness with respect to substrate W of various plate thickness.

Figure 1:
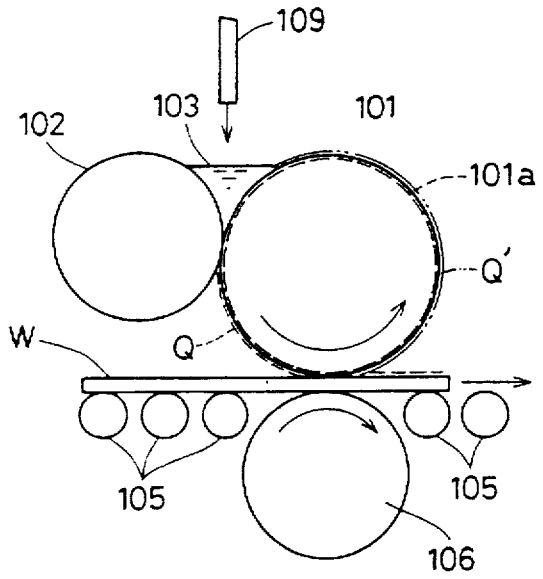
FIG.1 PRIOR ART
FIG. 1 is a schematic sectional view of a conventional roll coater.
Figure 2:
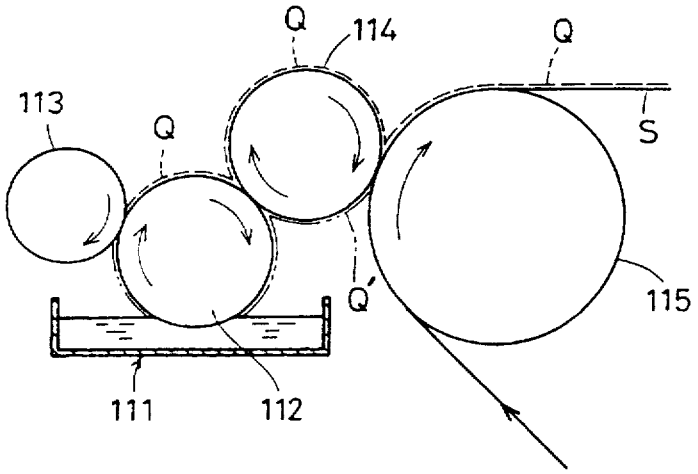
FIG.2 PRIOR ART
FIG. 2 is a schematic sectional view of another conventional roll coater.

Doctor roll 102 of the conventional roll coater of FIG. 1 does not have a notch 2c as shown in FIG. 3. Therefore, the coating liquid sandwiched by doctor roll 102 and coating rubber roll 101 is pulled by the surface tension of both the coating liquid adhering to doctor roll 102 and that adhering to coating rubber roll 101. The film of coating liquid Q on the surface of coating rubber roll 101 becomes uneven in thickness and shows a stripe pattern of a constant pitch, resulting in irregularity in the coated film formed on substrate W.

The roll coater according to the present invention of FIG. 3 allows the formation of a liquid layer of uniform thickness on the surface of metal roll 1 by fine-adjusting the angle of metal doctor 2 so that shearing force is exerted between notch 2c of metal doctor 2 and coating film Q on the surface of metal roll 1.

The coating liquid stored in coating liquid reservoir 3 is stirred up by stirring rod 90 (namely, the nozzle 9 traveling in reservoir 3) to be always uniform. Unevenness does not occur in the thickness of the film of coating liquid Q formed on the surface of metal roll 1 to result in the formation of a coated film of uniform film thickness on the surface of substrate W.

Figure 4:
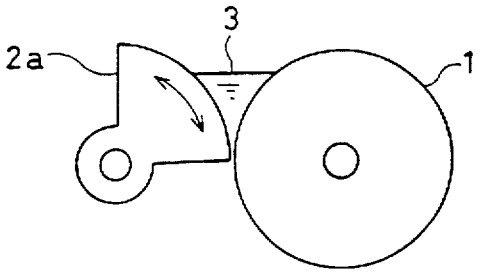
FIG. 4 is a schematic sectional view of the main part of the roll coater according to a second embodiment of the present invention.

The periphery of metal doctor 2 in the first embodiment is substantially circular with two notches formed therein. However, the present invention is not limited to this and the metal doctor may take any configuration as long as it has a step portion and a smooth portion of a substantially circular configuration. The main part of the roll coater of a second embodiment of the present invention, which is a modification of the first embodiment, is shown in FIG. 4. Referring to FIG. 4, a doctor roll 2a forming a contact with metal roll 1 of the roll coater has a periphery of a quartered circle provided to swing around the center portion of the circle. The angle of metal doctor 2a is selected so that the circular portion thereof and metal roll 1 form a contact. Coating liquid reservoir 3 is provided above the contact portion. The angle of metal doctor 2a can be fine-adjusted to apply shearing force to the coating liquid at the boundary of the circular portion and the step portion of metal doctor 2a, whereby the film thickness of the coating liquid adhering to metal roll 1 is made constant.

The device of this second embodiment can be realized by replacing metal doctor 2 of the roll coater of FIG. 3 with metal doctor 2a of FIG. 4. The remaining components of FIG. 3 can be used for this device.

Therefore, detailed description thereof will not be repeated here.

Figure 5:
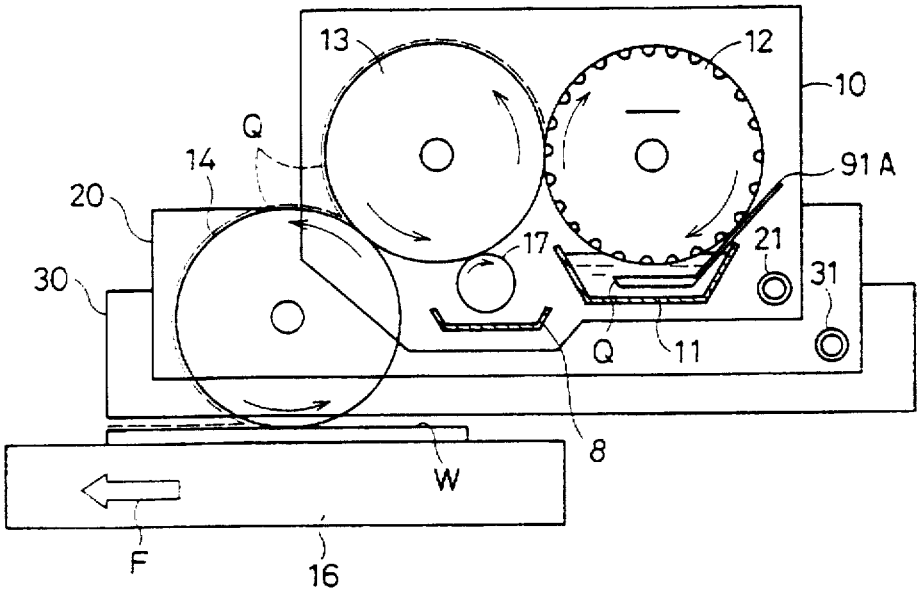
FIG. 5 is a schematic sectional view of a roll coater according to a third embodiment of the present invention.

A roll coater according to a third embodiment of the present invention is shown in FIG. 5. Referring to FIG. 5, this roll coater includes a fixed base 30, a lower support frame 20 attached to base 30 swingable around a shaft 31 provided in the proximity of one end of base 30, an upper support frame 10 swingably attached around a shaft 21 in the proximity of one end of lower support frame 20, and a substrate transportation fixing bed 16 provided beneath base 30 to hold substrate W thereupon for transferring the same in a direction indicated by arrow F. Upper support frame 10 includes a coating liquid reservoir 11 for storing coating liquid Q; a pickup roll 12 formed of a gravure metal roll having a plurality of depressions on the surface thereof, connected to upper support frame 10 to have a portion of the outer circumferential face thereof dipped in coating liquid Q in coating liquid reservoir 11, rotatable around the axis thereof, and movable in a horizontal direction of upper support frame 10; an offset rubber roll 13 connected to upper support frame 10 at the axis thereof to form a contact with pickup roll 12 by adjustable pressure and to rotate around the axis thereof; a scraper roll 17 provided to form contact with the outer circumferential face of offset rubber roll 13 at the lower portion of offset rubber roll 13; and a tray 8 provided beneath scraper roll 17 for receiving remaining coating liquid scraped off from the outer circumferential face of offset rubber roll 13 by a scraper roll 17. A stirring rod 91A for stirring up coating liquid Q to maintain the evenness of coating liquid Q is provided in coating liquid reservoir 11.

A coating rubber roll 14 is provided in lower support frame 20 to be rotatable around a predetermined rotation axis.

As described above, upper support frame 10 can swing around shaft 21. Upper support frame 10 is generally biased downwards by gravity, so that offset rubber roll 13 is pressed against coating rubber roll 14. Lower support frame 20 can also swing around shaft 31. Therefore, the load of upper support frame 10 and its attachment, the load of lower support frame 20, and the load of coating rubber roll 14 itself are applied to coating rubber roll 14 to be pressed against the surface of substrate W at a predetermined pressure.

The roll coater of FIG. 5 operates as follows. Coating liquid reservoir 11 is provided with coating liquid Q in advance. Coating liquid reservoir 11 stores an amount of coating liquid Q so that at least a portion of the outer circumference face of pickup roll 12 is dipped into coating liquid C. Coating liquid Q is stirred up by stirring rod 91A to be maintained in evenness.

Offset rubber roll 13 rotates counterclockwise as shown in FIG. 5. Coating rubber roll 14 also rotates counterclockwise as shown in FIG. 5. Pickup roll 12 and scraper roll 17 both rotate clockwise in FIG. 5.

The rotation of pickup roll 12 causes an amount of coating liquid Q in coating liquid reservoir 11 to adhere to the outer circumferential face of pickup roll 12. The carried off coating liquid is transferred to the outer circumferential face of offset rubber roll 13 via the nip between pickup roll 12 and offset rubber roll 13. The coating liquid Q on offset rubber roll 13 is offset to coating rubber roll 14 at the nip between coating rubber roll 14 and offset rubber roll 13.

A fixing bed 6 receives substrate W from a substrate supplying device (not shown) to take and hold substrate W thereupon. Fixing bed 16 transports substrate W in a direction indicated by arrow F while holding substrate W. At this time, coating rubber roll 14 is pressed upon substrate W and rotates counterclockwise, as shown in FIG. 5. Coating liquid Q on coating rubber roll 14 is transferred to the surface of substrate W to form a film of uniform thickness on substrate W. Fixing bed 16 travels to a terminal location. A substrate transporting device (not shown) takes away substrate W from fixing bed 16. Fixing bed 16 then returns to the starting location to repeat the above-described operation.

The coating liquid Q on offset rubber roll 13 is transferred to coating rubber roll 14 at the nip with coating rubber roll 14. However, in some cases, part of liquid Q on roll 14 is not transferred to substrate W and is again transferred to offset rubber roll 13. If this remaining coating liquid is not removed, it will be transferred to pickup roll 12 to be re-introduced into coating liquid reservoir 11 by pickup roll 12. This will contaminate the clean coating liquid Q in coating liquid reservoir 11 and degrade its quality.

Scraper roll 17 and tray 8 are provided to avoid this problem. Scraper roll 17 contacts the outer circumferential surface of offset rubber roll 13, downstream of coating rubber roll 14 and upstream of pickup roll 12. Scraper roll 17 removes coating liquid remaining on the outer circumference face of offset rubber roll 13. Tray 8 receives the coating liquid scraped off the outer circumferential face of offset rubber roll 13 by scraper roll 17. The provision of scraper roll 17 reduces the possibility of the coating liquid remaining on the outer circumference surface of offset rubber roll 13 to be introduced into coating liquid reservoir 11 via pickup roll 12.

It is assumed that the length of scraper roll 17 is smaller than that of offset rubber roll 13. This means that scraper roll 17 makes contact with only one portion of the outer circumferential face of offset rubber roll 13. Only the coating liquid forming contact with scraper roll 17 of the coating liquid remaining on the outer circumferential surface of offset rubber roll 13 is removed. There is a possibility that the coating liquid permanently remains on other regions. This remaining coating liquid may be re-introduced to coating liquid reservoir 11 via pickup roll 12 and contaminate coating liquid Q. There is also a possibility of generating a coated film of uneven thickness on substrate W due to a permanent coating liquid layer formed on the outer circumferential face of offset rubber roll 13.

The roll coater of FIG. 5 includes a device (not shown) for reciprocating scraper roll 17 along the axial direction within a predetermined range. The reciprocation of scraper roll 17 in the axial direction eliminates the region on the outer circumferential face of offset rubber roll 13 which does not contact the scraper roll 17. Because all the remaining coating liquid on the outer circumferential face of offset rubber roll 13 is scraped off by scraper roll 17, there is no possibility of coating liquid Q in coating liquid reservoir 11 being contaminated or a permanent film of coating liquid layer being formed on offset rubber roll 13. Therefore, a coated film with minimal change in film thickness can be formed on substrate W.

Pickup roll 12 in the roll coater of FIG. 5 can move leftwards and rightwards. Pickup roll 12 can have the pressure adjusted arbitrarily in forming contact with offset rubber roll 13 to maintain the amount of coating liquid adhering to offset rubber roll 13 at a constant amount even if the viscosity of coating liquid Q changes. By adjusting the rotation speeds of offset rubber roll 13 and coating rubber roll 14, the thickness of the layer of coating liquid Q formed on coating rubber 14 can be maintained at a constant value regardless of the viscosity of coating liquid Q. Therefore, variation in the thickness of coated layer does not occur in forming substrate W.

Figure 5A:
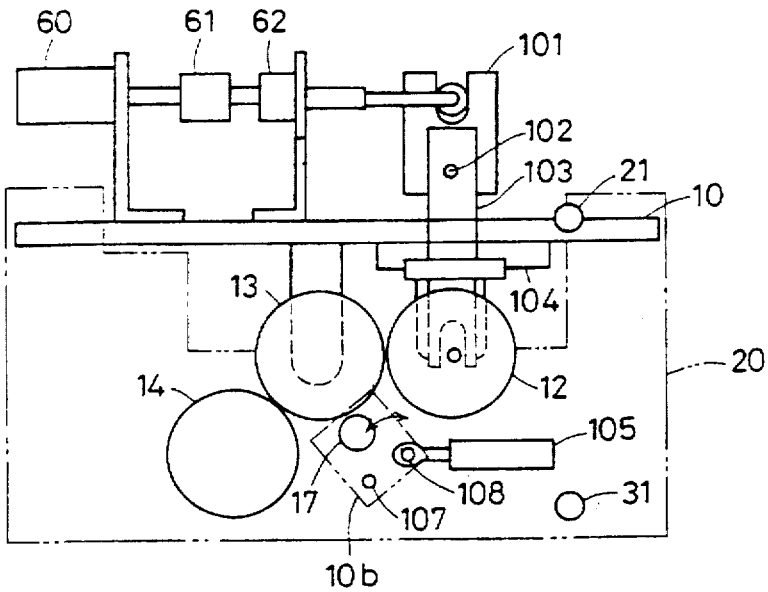
FIG. 5A schematically shows the mechanism for adjusting the contact pressure and the gap size between rolls 12 and 13 of a third embodiment of the present invention.

Referring to FIG. 5A, the mechanism for adjusting the contact pressure and gap size between rolls 12 and 13 includes a motor 60 fixed on upper support frame 10, a ball thread 62 connected to the rotation axis of motor 60 via coupler 61, a member 101 fixed to an end of ball thread 62, movable according to the extension of ball thread 62, a gravure roll holder 103 rotatably fixed around shaft 102 beneath member 101, and a linear guide 104 for guiding the horizontal traverse of gravure roll holder 103. A roll 13 is mounted beneath upper support frame 10.

The rotation of motor 60 is transmitted to ball thread 62 via coupler 61 to be converted into a horizontal movement. In response to the extension of ball thread 62, member 101 and holder 103 move in the horizontal direction to adjust the contact pressure and gap size between rolls 12 and 13.

The mechanism of adjusting the contact pressure and gap amount between rolls 13 and 14 is similar to that described with reference to FIG. 3A. Therefore, the detailed descriptions thereof will not be repeated here.

Referring to FIG. 5A, the mechanism for adjusting the contact scraper roll 17 and roll 13 includes a scraper roll frame 106 rotatably attached to lower support frame 20 at a supporting point 107 for holding scraper roll 17, and an air cylinder 105 having the rod end thereof rotatably attached to a spindle 108 of frame 106 fixed to lower support frame 20.

In accordance with the degree of expansion of air cylinder 105, frame 106 rotates around supporting point 107 to control the contact between the scraper roll 17 and roll 13.

Figure 6:
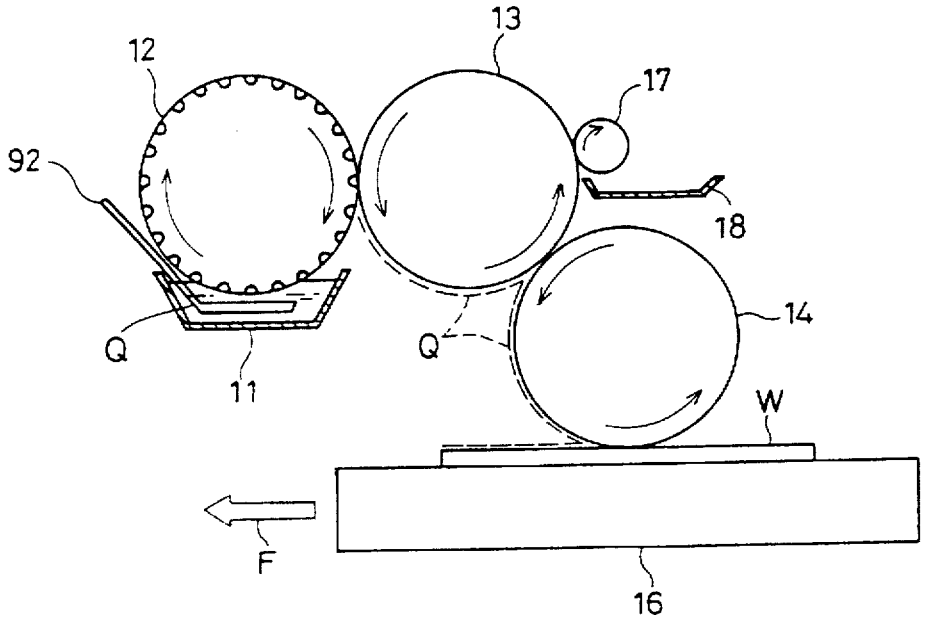
FIG. 6 is a schematic sectional view of a roll coater according to a fourth embodiment of the present invention.

FIG. 6 schematically shows the main part of a roll coater of a fourth embodiment of the present invention, which is a modification of the roll coater of FIG. 5. The roll coater of FIG. 6 differs from that of FIG. 5 in that pickup roll 12, offset rubber roll 13, and coating liquid reservoir 11 are provided in a direction opposite to those in FIG. 5 with respect to coating rubber roll 14. The location of scraper roll 17 is also changed according to the modification of the positions of rolls 12 and 13. Referring to FIG. 6, scraper roll 17 is provided downstream of coating rubber roll 14 and upstream of pickup roll 12 at the outer circumferential face of offset rubber roll 13. Specifically, scraper roll 17 is provided to contact offset rubber roll 13 right above coating rubber roll 14. A tray 18 for receiving coating liquid scraped off from the outer circumferential face of offset rubber roll 13 by scraper roll 17 is provided beneath scraper roll 17.

The operation of the roll coater of FIG. 6 is identical to that of the roll coater of the third embodiment of FIG. 5. Therefore, detailed descriptions thereof will not be repeated here.

Thus, according to the present invention, the coating liquid remaining on the coating rubber roll is collected by a scraper. There is no possibility of any remaining coating liquid mixing with fluid in the coating liquid reservoir because the coating liquid remaining on the coating rubber roll is removed even when the coating rubber roll is longer than the horizontal width of the substrate or when substrates are transported intermittently. Degradation of the quality of the clean coating liquid in the coating liquid reservoir is avoided to allow a more critical control of the film thickness of the coated film formed on the substrate.

The change in film thickness in the transportation direction of the substrate is reduced in comparison with a conventional device even if the length of the substrate in the transportation direction is longer than the outer circumference of the coating rubber roll. It is therefore possible to form a coated film of constant film thickness.

It is possible to form a coated film of a desired film thickness with a coating liquid of various viscosities by adjusting the gap or pressing force between rolls and the rotation of speed of each roll.

Although the present invention has been described in detail according to four embodiments thereof, the present invention is not limited to the above-described embodiments. The means to stir the coating liquid stored in the coating liquid reservoir is not limited to the stirring rod described in the above embodiments. For example, the stirring means may include a pump for circulating the coating liquid stored in the coating liquid reservoir within a predetermined tube path. Alternatively, the stirring means may include means to stir the coating liquid stored within the reservoir by shaking the coating liquid reservoir. The stirring means may use various known methods.

Although a fixing bed is employed as a means for transporting substrates in the above-described embodiments, the uniformity of the film thickness can be improved to some degree by using a roll of the structure described in the present invention including a scraper, even if a substrate is transported using a substrate transportation roller and a backup roll shown in conventional art without using a fixing bed.

Although the present invention has been described and illustrated in detail, it is to be clearly understood that the same is by way of illustration and example only and is not to be taken by way of limitation, the spirit and scope of the present invention being limited only by the terms of the appended claims.

What is claimed is:

1. A coating device comprising:

a transporter for transporting discrete substrates piece by piece along a predetermined direction extending along a predetermined straight transportation path parallel to a surface to be coated of each substrate, said transporter including a bed member for holding one of said substrates to be transported, said bed member and said substrate held thereon being movable together in said predetermined direction along said predetermined transportation path;

a coating roll having an elastic outer circumferential face supplied with a coating liquid, for coating the coating liquid onto said surface of said substrate by contact at a contact position of said elastic outer circumferential face with said surface of said substrate, said coating roll being rotatable so that its elastic outer circumferential face moves in a direction opposite to the predetermined direction of the substrate at the contact position;

a coating liquid transfer roll made of metal and having an outer circumferential face on which said coating liquid is applied, for transferring said coating liquid to said elastic outer circumferential face of the coating roll by contact of said outer circumferential face of said coating liquid transfer roll with said elastic outer circumferential face of the coating roll at a transfer position, said coating liquid transfer roll being rotatable so that said outer circumferential face thereof is rotatable in a direction opposite to said elastic outer circumferential face of said coating roll at said transfer position, said coating liquid transfer roll having a rotation axis and transfers said coating liquid to said elastic outer circumferential face of said coating roll while rotating around said rotation axis and while said outer circumferential face of said coating liquid transfer roll contacts said elastic outer circumferential face of the coating roll;

a first support structure for rotatable supporting said coating liquid transfer roll for rotation around said rotation axis and for moving said coating liquid transfer roll between a first position wherein it is pressed against said coating roll with a predetermined pressure and a second position wherein it is spaced from said coating roll;

a coating liquid supplier for supplying a predetermined amount of coating liquid on said outer circumferential face of said coating liquid transfer roll;

a scraper for scraping off excess coating liquid adhering to said outer circumferential face of said coating liquid transfer roll at a location downstream of said transfer position with respect to the direction of rotation of said coating liquid transfer roll; and a receiver provided beneath said scraper for receiving said coating liquid scraped from said outer circumferential face of said coating liquid transfer roll by said scraper;

said first support structure comprising:

a first holding frame for holding said coating roll;

a second holding frame supported rotatably around a predetermined position in said first holding frame for holding said coating liquid transfer roll rotatably around said rotation axis thereof; and said second holding frame and said coating liquid transfer roll being biased downwards by the weight of said second holding frame and said coating liquid transfer roll to press said coating liquid transfer roll against said coating roll.

2. The coating device according to claim 1, wherein said coating liquid supplier includes a doctor member made of metal and having an outer face, the doctor member contacting said outer circumferential face of said coating liquid transfer roll so as to doctor said coating liquid onto said coating liquid transfer roll.

3. The coating device according to claim 2, wherein said doctor member has an outer circumferential face divided into a smooth portion and a notch portion to define a coating liquid reservoir region for storing coating liquid above a shearing gap between said smooth portion and said coating liquid transfer roll for allowing only a predetermined amount of coating liquid from said coating liquid reservoir region to pass the shearing gap by coming into contact with said outer circumferential face of said coating liquid transfer roll, and further comprising:

an adjuster for adjusting the amount of coating liquid passing through said shearing gap and adhering to said outer circumferential face of said coating liquid transfer roll, by supporting said doctor member to contact said coating liquid transfer roll at said smooth portion, and by supporting said doctor member towards said coating liquid transfer roll with a predetermined pressure while enabling it to be movable therefrom.

4. The coating device according to claim 3, further comprising a stirrer for stirring a coating liquid in said coating liquid reservoir region.

5. The coating device according to claim 4, wherein said stirrer comprises a stirring rod provided within said coating liquid reservoir region for stirring a coating liquid in said coating liquid reservoir region.

6. The coating device according to claim 3, wherein said scraper contacts said outer circumferential face of said coating liquid transfer roll at a position upstream of said shearing gap with respect to the direction of rotation of said coating liquid transfer roll.

7. The coating device according to claim 6, further comprising a reciprocator for reciprocating said scraper in a direction parallel to a rotation axis of said coating liquid transfer roll.

8. The coating device according to claim 6, wherein said scraper comprises a blade provided so that a longitudinal direction thereof extends parallel to a rotation axis of said coating liquid transfer roll.

* * * * *